US007918116B2

(12) United States Patent
Quach

(10) Patent No.: US 7,918,116 B2
(45) Date of Patent: Apr. 5, 2011

(54) DEADBOLT LOCK KNOB RESTRICTOR

(76) Inventor: Trung Quach, Bonney Lake, WA (US)

( * ) Notice: Subject to any disclaimer, the term of this patent is extended or adjusted under 35 U.S.C. 154(b) by 102 days.

(21) Appl. No.: 12/335,560

(22) Filed: Dec. 16, 2008

(65) Prior Publication Data

US 2009/0235704 A1 Sep. 24, 2009

Related U.S. Application Data

(60) Provisional application No. 61/070,244, filed on Mar. 19, 2008.

(51) Int. Cl.
*E05B 13/00* (2006.01)

(52) U.S. Cl. ..... 70/416; 70/452; 292/288

(58) Field of Classification Search ..... 70/211, 70/416, 429, 430; 292/258, 288, 339, 347, 292/DIG. 2

See application file for complete search history.

(56) References Cited

U.S. PATENT DOCUMENTS

| | | | | | |
|---|---|---|---|---|---|
| 3,423,974 | A * | 1/1969 | Bernsley | ..... | 70/416 |
| 3,862,556 | A | 1/1975 | Moses | | |
| 3,933,014 | A | 1/1976 | Moses | | |
| 4,279,137 | A * | 7/1981 | Cook | ..... | 70/416 |
| 5,007,263 | A * | 4/1991 | Taylor | ..... | 70/416 |
| 5,313,812 | A * | 5/1994 | Eklund et al. | ..... | 70/416 |
| 5,369,971 | A * | 12/1994 | Sheppard | ..... | 70/416 |
| 5,515,704 | A | 5/1996 | Van Nguyen | | |
| 5,651,279 | A | 7/1997 | Berton et al. | | |
| 5,950,465 | A | 9/1999 | Schultz et al. | | |
| 6,301,941 | B1 * | 10/2001 | Nicholsfigueiredo | ..... | 70/416 |
| 6,332,344 | B1 | 12/2001 | Montoya | | |
| 6,976,716 | B2 | 12/2005 | Lin | | |
| 6,993,944 | B2 | 2/2006 | Hicks | | |
| 7,216,903 | B1 | 5/2007 | Kent et al. | | |
| 7,264,285 | B1 * | 9/2007 | Ross | ..... | 70/416 |
| 7,284,400 | B1 | 10/2007 | Agozzino | | |
| 7,418,847 | B2 * | 9/2008 | Kosi | ..... | 70/416 |
| 2009/0013739 | A1 * | 1/2009 | Vyskocil, Jr. | ..... | 70/416 |

* cited by examiner

*Primary Examiner* — Suzanne D Barrett
*Assistant Examiner* — Christopher Boswell
(74) *Attorney, Agent, or Firm* — Dean A. Craine

(57) ABSTRACT

A deadbolt knob restrictor used to prevent the rotation of the inside knob on the deadbolt lock. The restrictor includes a ring member designed to fit between the cover plate located on the inside surface of the door. Attached to the ring member are two perpendicularly aligned support arms with a pin-style hinge formed on their distal ends. Attached to the hinge is an L-shaped latch. Formed on the latch is a cam surface which presses against a spring loaded piston disposed between the cam surface and the support arm. The latch includes a long leg that may be disposed transversely over the ring member, and a short leg that may be placed adjacent to the wide surface of the deadbolt lock's turn knob to prevent its rotation. During assembly, the ring member is placed under the locks inside cover plate. During use the piston forcibly holds the latch in a locked or unlocked position against the turn knob. The latch may be rotated in the opposite direction so that the turn knob is free to rotate to the unlock position.

4 Claims, 2 Drawing Sheets

DEADBOLT LOCK KNOB RESTRICTOR

This is a utility patent application which claims benefit of U.S. Provisional Application No. 61/070,244, filed on Mar. 19, 2008.

COPYRIGHT NOTICE

Notice is hereby given that the following patent document contains original material which is subject to copyright protection. The copyright owner has no objection to the facsimile or digital download reproduction of all or part of the patent document, but otherwise reserves all copyrights whatsoever.

BACKGROUND OF THE INVENTION

1. Field of the Invention

This invention pertains to locks and more particularly to door locks used to prevent tampering or attacks.

2. Description of the Related Art

Internal deadbolt locks include an interior bolt that moves inward and outward from the outside edge of the door to selectively disengage and engage, respectively, a complimentary-shaped hole formed on the door jam when the door is closed. The lock normally includes an outer key hole coupled to an internal lock assembly that allows the bolt to be manually moved inward and outward by a user standing outside the door with a proper key. Attached to the lock assembly and located on the inside surface of the door is a knob that allows the bolt to be manually moved inward and outward when standing inside the building. Most deadbolt locks include a decorative cover plate located over the inside surface of the door that fits under the lock that helps hold the knob in place on the door. Sometimes screws extend through the cover plate to hold it in place on the door.

It is well known that if the key to a deadbolt lock is lost or stolen, an unauthorized person may use the key to unlock the deadbolt lock and enter the building. Heretofore, various devices have been invented that are designed to prevent rotation of the inside knob on a deadbolt lock. Unfortunately, all the devices are limited to a specific deadbolt lock design and usually require modification of the door itself.

What is needed is a deadbolt lock knob resistor that can be used on a large variety of different deadbolt locks and does not require modification of the door.

SUMMARY OF THE INVENTION

The above object and other objects are met by the deadbolt lock knob restrictor disclosed herein used to prevent the manual rotation of the inside knob on the deadbolt lock with a key inserted into the outside key lock. The restrictor includes a ring member designed to fit between the decorative cover plate and the inside surface of the door. Attached to one side of the ring member is a laterally extending flange surface with two perpendicularly aligned support arms with a pin-style hinge receiving ear formed on their distal ends.

The restrictor also includes an L-shaped latch. The latch includes a long leg with a cylindrical pin receiving tube attached at its distal end. During assembly, the cylindrical pin receiving tube is longitudinally aligned with the two receiving ears on the two support arms. The two ears and the receiving tube are held in a longitudinal alignment with one or two pins.

Formed on the inside surface of the cylindrical pin receiving tube is a cam surface. The cam surface presses against a spring loaded piston disposed between the cam surface and the flange surface on the ring member.

The long leg on the latch is sufficient in length so that when the latch is pivoted inward, it extends transversely over the ring member and the short leg on the latch is placed adjacent to the deadbolt's inside turn knob. During use the spring-loaded piston exerts pressure on the receiving tube to forcibly hold the latch in a locked position against the turn knob.

During assembly, the ring member is placed under the decorative cover plate. Two-screws may be used on the cover plate hold both the cover plate and the ring member in a fixed position over the inside surface of the door. The ring member may then be rotated under the cover plate so that the position of the latch may be positioned against the wide surface of the turn knob when the knob is moved to the locked position. When the latch is rotated in the opposite direction, the knob is free to rotate to the unlock position. Because the ring member may be rotated to any position under the cover plate, the resistor may be used with different deadbolt locks and with both right and left-handed locks.

In the preferred embodiment, the ring member is made of two half-ring elements that enable them to be attached to the door by slightly loosening the cover plate and then tightening the cover plate over the two half-ring elements.

DESCRIPTION OF THE PREFERRED EMBODIMENT(S)

Figure 1:
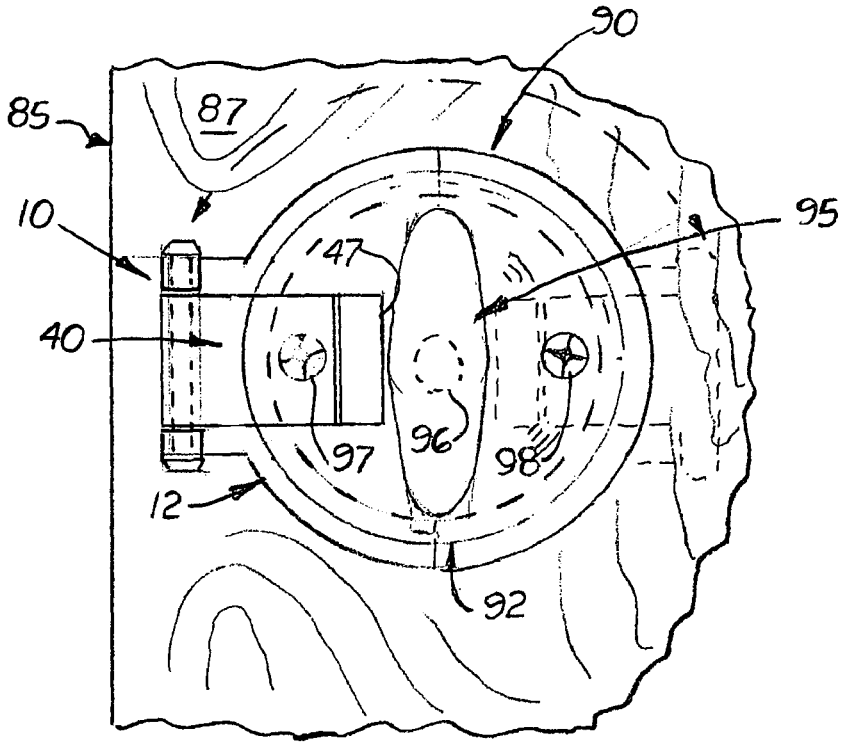
FIG. 1 is a top plan view of the deadbolt lock knob resistor mounted on a door bolt lock shown in a locked position.
Figure 2:
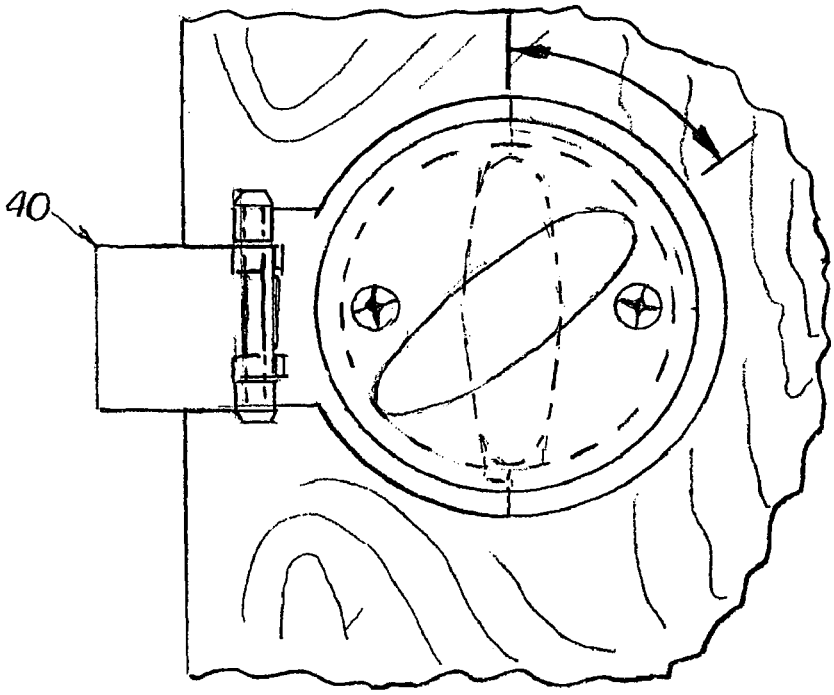
FIG. 2 is a top plan view of a deadbolt lock knob resistor shown on FIG. 1 shown in an unlocked position.
Figure 3:
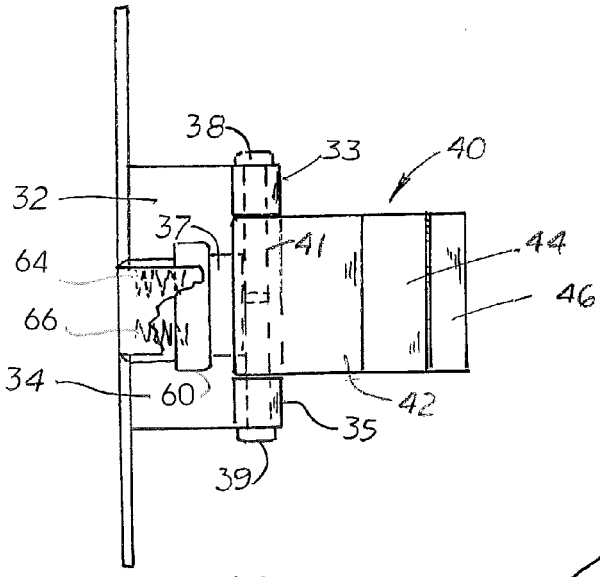
FIG. 3 is a side elevational view of the deadbolt lock knob resistor in an unlocked position.
Figure 4:
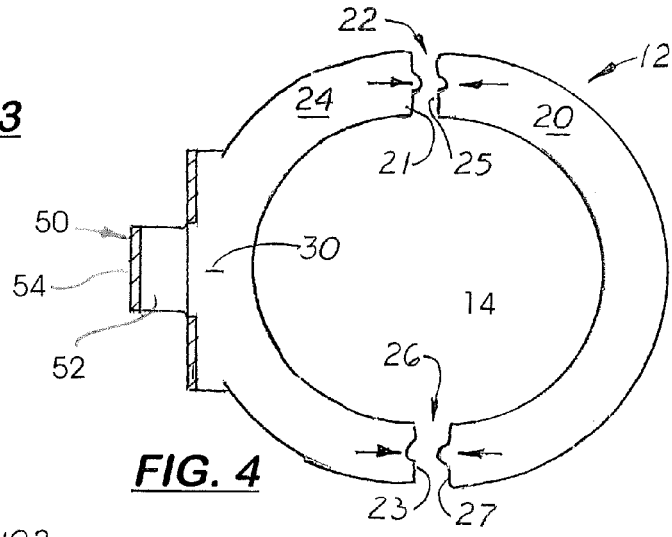
FIG. 4 is a top plan view showing the ring member made of two half-ring elements joined together.

Referring to the accompanying FIGS. 1-5, there is shown a deadbolt lock knob restrictor 10 used to prevent the rotation of the inside knob 95 on the deadbolt lock 90 attached to a door 85. The restrictor 10 is used to prevent manual rotation of the inside knob 95 from a locked position to an unlocked position using a key inserted into the lock's outer key hole.

The restrictor 10 includes an L-shaped latch 40 that includes a wide abutment surface 47 that can be selectively positioned against the wide surface on the inside knob 95 to prevent its rotation to an unlocked position. During use, the knob 95 is moved to a locked position and the latch 40 is then rotated so that its abutment surface 47 is positioned against the wide surface of the knob 95 to stop its rotation.

The restrictor 10 includes a flat ring member 12 designed to fit between the lock's inside cover plate 92 and the inside surface 87 of a door 85. The ring member 12 is relatively thin structure and has a sufficient diameter to fit under the outer edge of an inside cover plate 92. A large center 14 opening is formed in the ring member 12 so that the deadbolt's locking assembly 96 and the cover plate's connection screws 97, 98 may continue to extend through the ring member 12 to hold the deadbolt lock 90 in place.

In the preferred embodiment, the ring member 12 is made of a first half-ring element 20 and a second half-ring element 24 that are joined together in an end-to-end manner to form a large circular ring. Formed on the adjoining edges of the first and second ring members 20, 24 are two detent mechanisms 22, 26 used to keep the adjoining edges 21, 23, 25, 27 aligned.

Attached or integrally formed on the outer edge of the second half-ring element 24 is a laterally extended flange surface 30. Formed on the flange surface 30 are two perpendicularly aligned support arms 32, 34. The two support arms 32, 34 are parallel and extend outward from the flange surface 30. Formed on their distal ends are two hollow ears 33, 35. The ears 33, 35 are longitudinally aligned and designed to receive two pins 38, 39. The ears 33, 35 are also spaced apart so that a wide void area 37 is formed therebetween.

The latch 40 is designed to rotate in a 180 degree arc over the ends of the two support arms 32, 34. The latch 40 includes a longitudinally aligned long leg 42, a middle leg 44, and a distal short leg 46. In the preferred embodiment, the middle leg 44 is aligned at angle of approximately 75 degrees from the long leg 42. The short leg 46 is angled approximately 105 degrees from the middle leg 44 and approximately parallel to the long leg 42. Formed on the distal end of the long leg 42 is a cylindrical pin receiving tube 41.

Figure 5:
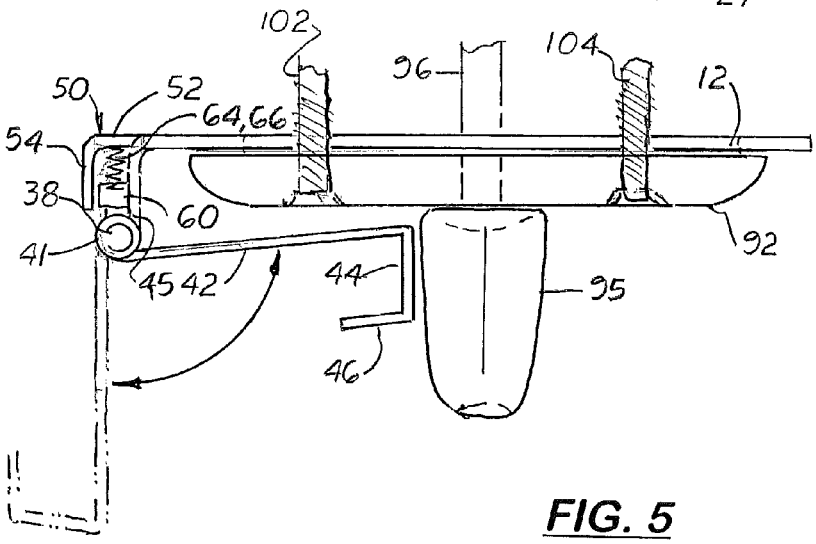
FIG. 5 is a top elevational view of the deadbolt lock knob resistor mounted on a deadbolt lock showing the latch being moved between a locked to an unlocked position.

Formed on the outer edge of the flange surface 30 and below the void area 37 and between the two support arms 32, 34 is a short, L-shaped bracket 50. As shown in FIG. 5, the bracket 50 includes a lower base 52 and a perpendicularly aligned rear surface 54. Disposed inside the bracket 50 is an elongated friction pad 60 supported by two springs 64, 66. The springs 64, 66 bias the friction pad 60 upward and against the cylindrical pin receiving tube 41 formed on the distal end of the long leg 42. A cam surface 45 is attached to the inside surface of the tube 41 so that the latch 40 may snap forward into a locked transverse position over the ring member 12 and against the knob 95. When rotated rearward into an unlocked position, the cam surface 45 disengages and pressure on the latch 40 is reduced thereby enabling the latch 40 to easily move to an unlocked position.

The long leg 42 of the latch 40 is sufficient in length so that when the latch 40 is disposed transversely over the ring member 12, the short leg 46 of the latch 40 acts as an abutment surface 47 against the wide surface of the knob 95. During use the friction pad 60 forcibly presses against the cam surface 45 to hold the latch 40 in a locked position against the knob 95.

During assembly, the ring member 12 is placed under the lock's outer cover plate 92. The ring member 12 is rotated under the cover plate 92 so that the latch 40 may be positioned on one side of the knob 84 to prevent its rotation. The connection screws 102, 104 are tightened so that the ring member 12 and cover plate 92 are held in a fixed position. The ring element 12 is then rotated so that the latch 40 may be rotated downward and positioned against the wide surface of the knob 95 to block its rotation when moved to the locked position. When the latch 40 is rotated upward, (or outward towards the door's edge) the knob 95 is free to rotate to the unlock position.

In the preferred embodiment, the first and second half-ring members 20, 24 form an enclosed ring structure 12 approximately 2-⅝ inches in diameter. When assembled, the center opening 14 on the ring member 12 is approximately 2 inches in diameter. Each half-ring element 20, 24 is approximately ⅜ inch wide and 1/16 inch thick. The two support arms 32, 34 measure approximately ⅝ inch in length and ⅜ in width. The center void 37 between the two support arms 32, 34 is approximately 9/16 inches wide. The long leg 42 on the latch 40 is approximately 1-¼ inches in length and 1 inch in width. The middle leg 44 is approximately ¾ inches in length and 1 inch in width. The short leg 42 is approximately ¼ inch in length and 1 inch in width.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A deadbolt knob restrictor used with a deadbolt lock on a door that includes an inside turn knob and an inside cover plate, comprising:

a. a ring member located on the inside surface of a door and under the cover plate of a deadbolt lock and located on the inside surface on a door, said ring member includes a center opening and a laterally extending flange surface;

b. two parallel support arms perpendicularly aligned on said flange surface of said ring member, said support arms being spaced apart forming a wide void area between them, when said ring member is located under the cover plate of the deadbolt lock each said support arm extends perpendicularly from and lateral to the cover plate, each said support arm includes a distal edge;

c. a hinge transversely aligned and supported by said distal edges of said support arms, said hinge being parallel with said ring member;

d. an L-shaped latch connected to said hinge and able to be rotated over said support arms in an 180 degree arc that extends from said center opening of said ring member and extending over said hinge, said latch includes a long leg and a middle leg said long leg and said middle leg being sufficient size so that when said latch is rotated on said support arms and extended transversely and inward over the cover plate on the deadbolt lock, said middle leg abuts the turn knob on the deadbolt lock when rotated to a locked position and prevents rotation of the turn knob; and, e. a spring loaded piston located between said hinge and said latch, said spring creates a biasing force against said latch to hold said latch in a transversely and inward position over the cover plate and to hold said middle section against the turn knob.

2. The deadbolt knob restrictor, as recited in claim 1, further including a cam surface disposed between said hinge and said spring.

3. The deadbolt knob restrictor, as recited in claim 1, wherein said ring member is made of two opposite, flat half-ring elements with adjoining edges.

4. The deadbolt knob restrictor, as recited in claim 3, further including a cam surface disposed between said hinge and said spring.

* * * * *